US005977842A

United States Patent [19]

Brown et al.

[11] Patent Number: 5,977,842

[45] Date of Patent: Nov. 2, 1999

[54] HIGH POWER BROADBAND COAXIAL BALUN

[75] Inventors: Kenneth W. Brown, Yucaipa; James R. Gallivan, Pomona; David R. Sar, Corona, all of Calif.

[73] Assignee: Raytheon Company, Lexington, Mass.

[21] Appl. No.: 09/108,688

[22] Filed: Jul. 1, 1998

[51] Int. Cl.[6] ..... H01P 5/10

[52] U.S. Cl. ..... 333/26; 333/33

[58] Field of Search ..... 333/26, 33

[56] References Cited

U.S. PATENT DOCUMENTS

| | | | |
|---|---|---|---|
| 2,925,566 | 2/1960 | Jasik | 333/26 |
| 3,217,274 | 11/1965 | Alford | 333/26 |
| 3,497,832 | 2/1970 | Cohn | 333/26 X |

*Primary Examiner*—Paul Gensler
*Attorney, Agent, or Firm*—David W. Collins; Andrew J. Rudd; Glenn H. Lenzen, Jr.

[57] ABSTRACT

A broadband, high power balun which includes plural sets of first and second coaxial cables. Each cable has a center conductor and a shield conductor. Each shield conductor of each cable within each set is connected to a shield conductor of the other coaxial cable of the set. The first input lead is connected to a first end of a center conductor of a first coaxial cable of each set. The second input lead is connected to a first end of a center conductor of a second coaxial cable of each set. A second end of a center conductor of a first coaxial cable of a set of coaxial cables provides an output lead for the balun. A second end of a center conductor of a second coaxial cable of a set of coaxial cables provides an output lead for the balun. A second end of each remaining center conductor of each coaxial cable of each set of coaxial cables is connected to a second end of a center conductor of a coaxial cable of another set of coaxial cables. The inventive balun design allows for larger center conductors and lower characteristic impedances than conventional baluns. This permits impedance matching across a broad bandwidth at high power levels.

9 Claims, 4 Drawing Sheets

FIG. 2
PRIOR ART
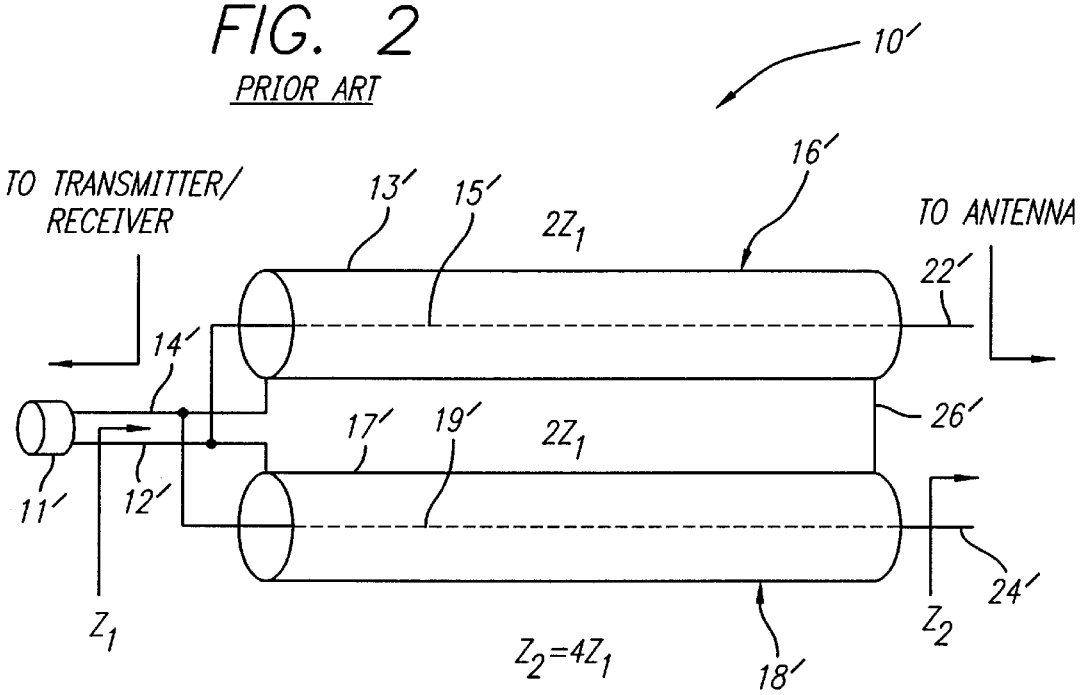
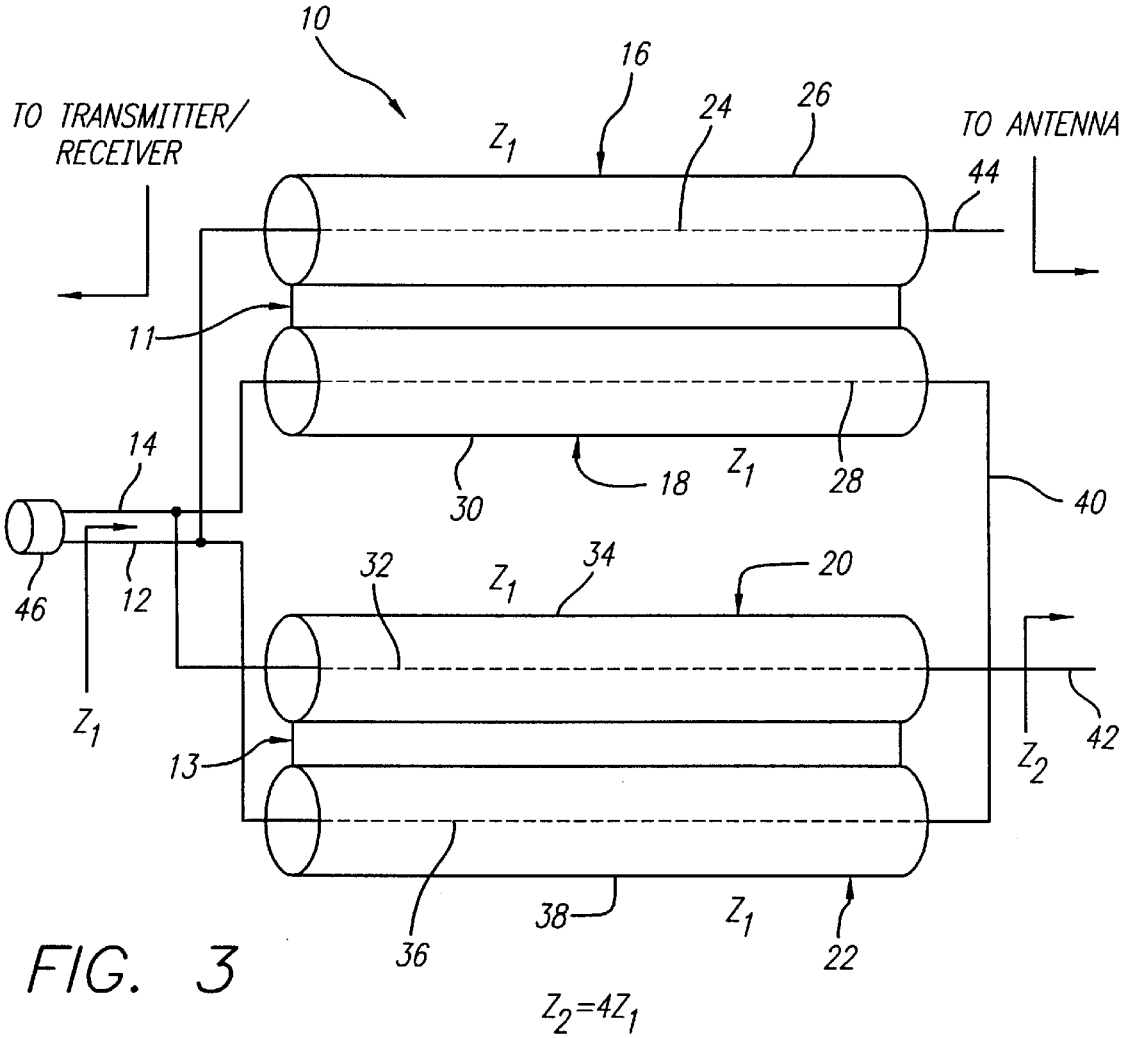
FIG. 3

FIG. 5
PRIOR ART
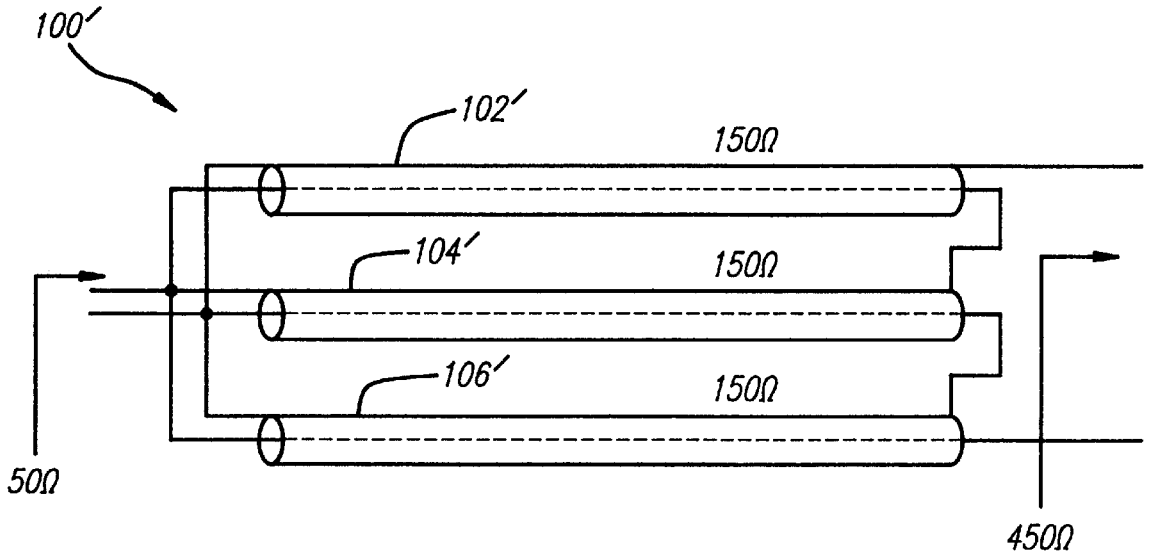
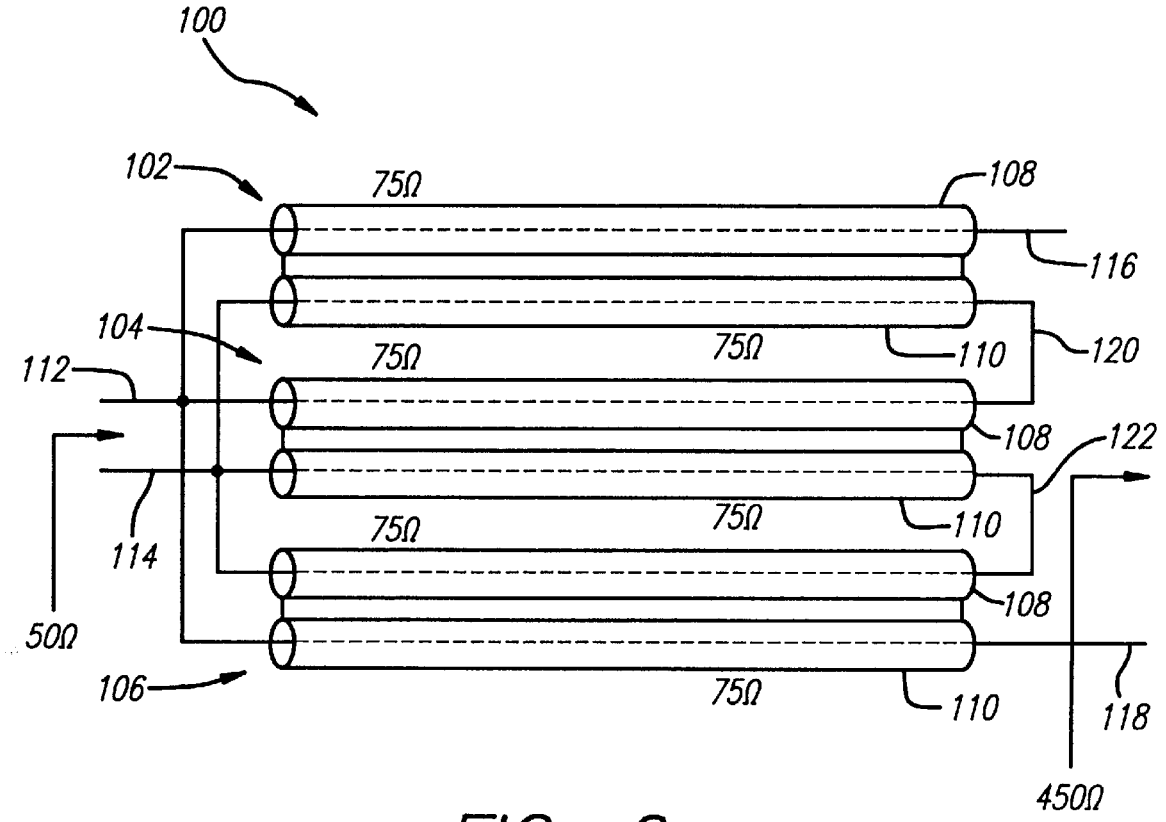
FIG. 6

FIG. 7 PRIOR ART
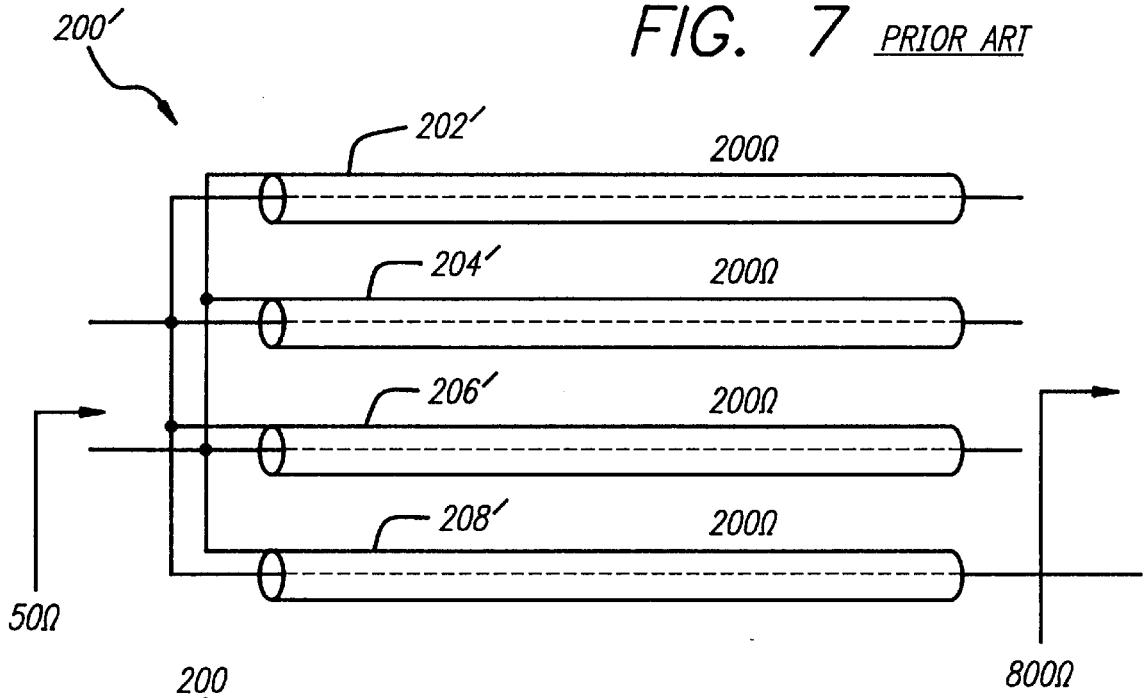
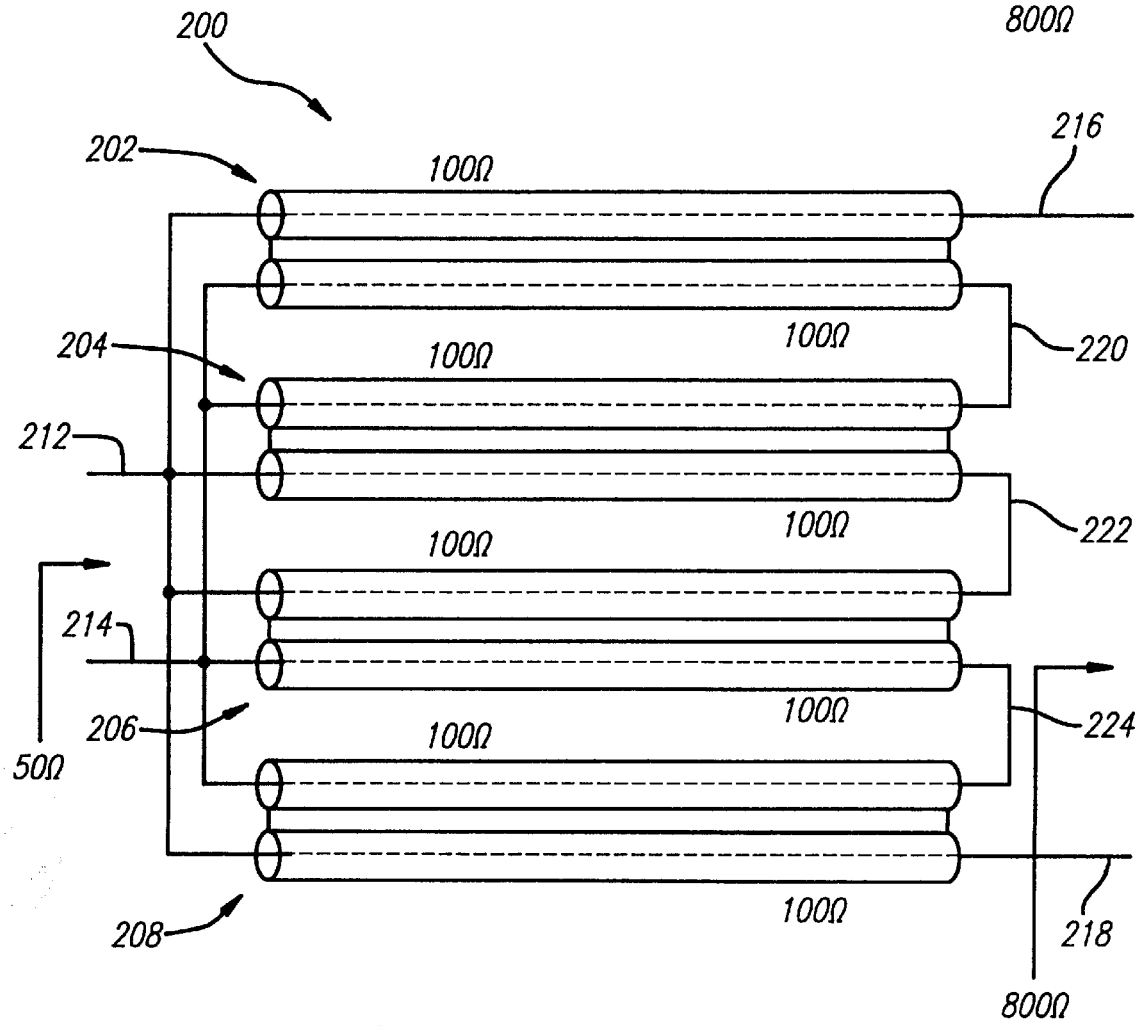
FIG. 8

HIGH POWER BROADBAND COAXIAL BALUN

This invention was made with Government support under Contract No. DAAB10-95-C-R061 awarded by Department of the Army. The Government has certain rights in this invention.

BACKGROUND OF THE INVENTION

1. Field of the Invention

The present invention relates to communication systems. More specifically, the present invention relates to coaxial baluns for interfacing transmitters and receivers to antennas.

2. Description of the Related Art

For certain applications, there is a need for a broadband, high power communication system. One such application is military where the broad bandwidth is required for secure spread spectrum communication and high power is required for long range. High power broadband communication systems require high power broadband antennas. Often these antennas have an input impedance that does not match the desired transmitter or receiver with which it is used. In such circumstances, baluns can be used to transform the impedance of the antenna to the impedance of the transmitter or receiver. When large bandwidths are desired, coaxial baluns are often used. Typically, a coaxial balun cable requires relatively small center conductors that limit their power handling capability.

Thus, there is a need in the art for a broadband, high power coaxial balun with improved power handling capability.

SUMMARY OF THE INVENTION

The need in the art is addressed by the broadband, high power balun of the present invention. The inventive balun includes plural sets of first and second coaxial cables. Each cable has a center conductor and a shield conductor. Each shield conductor of each cable within each set is connected to a shield conductor of the other coaxial cable of the set. The first input lead is connected to a first end of a center conductor of a first coaxial cable of each set. The second input lead is connected to a first end of a center conductor of a second coaxial cable of each set. A second end of a center conductor of a first coaxial cable of a set of coaxial cables provides an output lead for the balun. A second end of a center conductor of a second coaxial cable of a set of coaxial cables provides an output lead for the balun. A second end of each remaining center conductor of each coaxial cable of each set of coaxial cables is connected to a second end of a center conductor of a coaxial cable of another set of coaxial cables.

The inventive balun design allows for larger center conductors and lower characteristic impedances than conventional baluns. This permits impedance matching across a broad bandwidth at high power levels.

BRIEF DESCRIPTION OF THE DRAWINGS

FIG. 2 is a schematic diagram of the coaxial balun of FIG. 1.

FIG. 3 is a schematic diagram of a balun constructed in accordance with the teachings of the present invention.

FIG. 5 shows a 9:1 transforming balun constructed in accordance with conventional teachings.

FIG. 6 shows a 9:1 transforming balun constructed in accordance with the teachings of the present invention.

FIG. 7 shows a 16:1 coaxial balun constructed in accordance with conventional teachings.

FIG. 8 shows a 16:1 transforming balun constructed in accordance with the teachings of the present invention.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
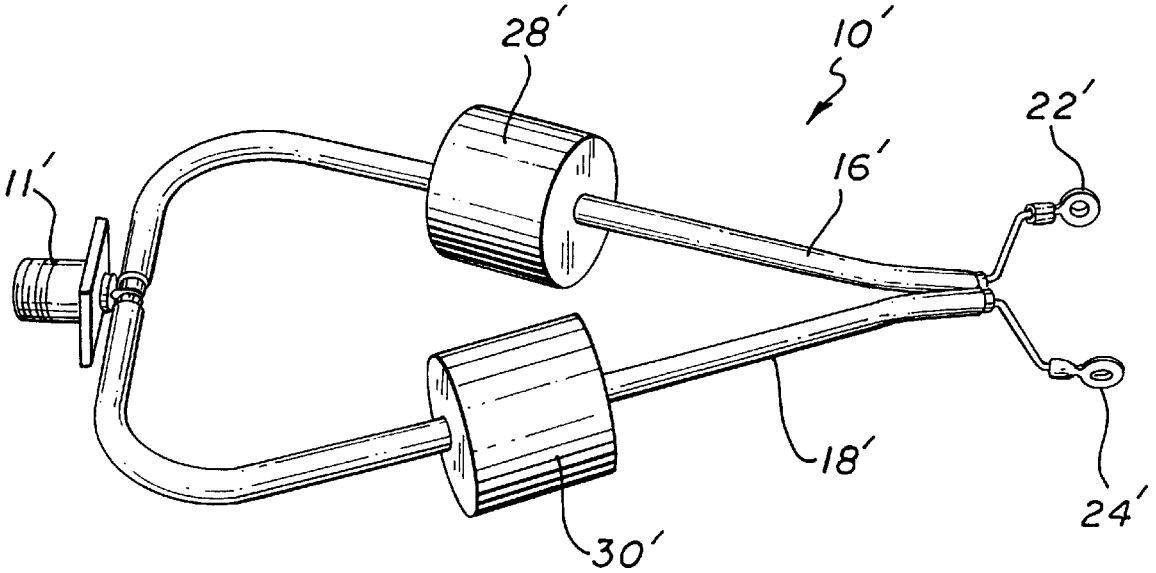
FIG. 1 PRIOR ART
FIG. 1 is a sketch of a conventional coaxial balun.

FIG. 1 is a sketch of a conventional coaxial balun. The balun 10' has a coaxial coupler such as a type N coaxial adapter 11' which connects to first and second coaxial cables 16' and 18'. The first and second coaxial cables 16' and 18' are, in turn, electrically connected to first and second connectors 22' and 24', respectively.

FIG. 2 is a schematic diagram of the coaxial balun of FIG. 1. First and second leads 12' and 14' extend from the coupler 11'. The first lead 12' is connected to the center conductor 15' of the first coaxial cable 16' and the shield 17' of the second coaxial cable 18'. The second lead 14' is connected to the shield 13' of the first coaxial cable 16' and the center conductor 19' of the second coaxial cable 18'.

The purpose of the balun 10' of FIG. 1 is to transform the characteristic impedance of a transmitter and/or receiver to four times its amount. This balun would be used in an application where the input impedance of an antenna is four times that of a transmitter/receiver that is to be used with the antenna. This type of balun requires coaxial cables with twice the characteristic impedance of the transmitter/receiver impedance.

In a typical application, the balun 10' of FIGS. I and 2 would be designed to transform a 200 ohm antenna input impedance to a 50 ohm transmitter output impedance by way of example. The required coaxial characteristic impedance for the balun would be 100 ohms, which would require a center conductor diameter of 0.019" (for a 0.21" outer conductor diameter with a Teflon dielectric).

At the transmitter/receiver end of the balun 10', the two 100 ohm coaxial cables 16' and 18' are connected in parallel, providing a 50 ohm impedance. At the antenna end of the balun 10', the 100 ohm coaxial cables 16' and 18' are connected in series, providing a 200 ohm impedance at the antenna.

The balun 10' of FIGS. 1 and 2 is band-limited at low frequencies. That is, as the frequency decreases towards DC (direct current) the balun 10' effectively shorts out the transmitter/receiver. The lower frequency range of the balun 10' was typically extended by inserting ferrites 28' and 30' around the coaxial cables 16' and 18', respectively, as shown in FIG. 1. Typically, a 10:1 reduction in the lower frequency of operation of this type of balun can be achieved by adding ferrites in this manner.

FIG. 3 is a schematic diagram of a balun 10 constructed in accordance with the teachings of the present invention.

Figure 4:
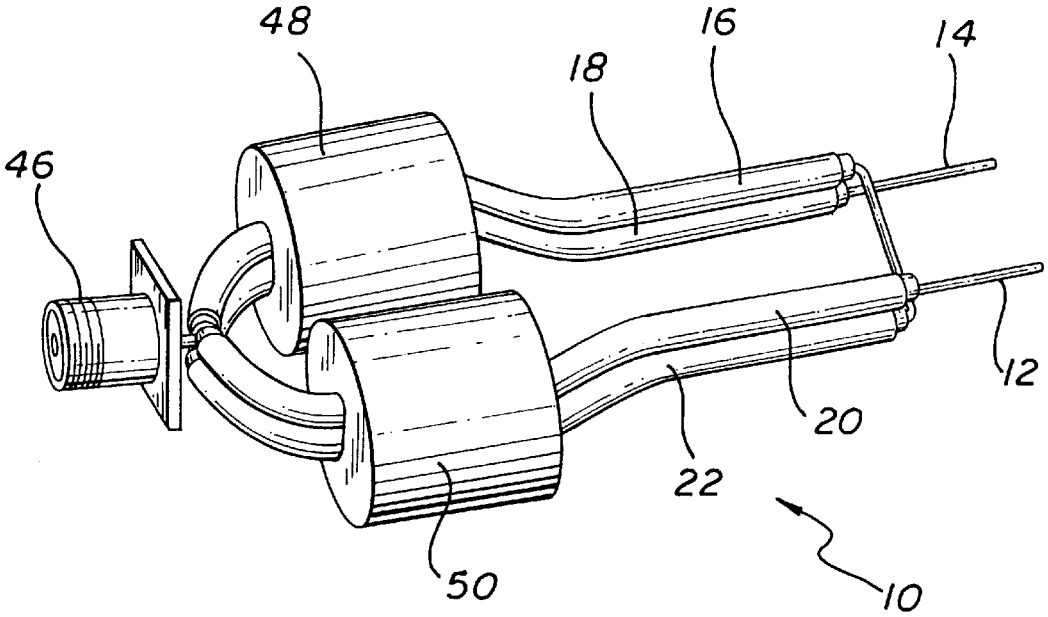
FIG. 4 is a sketch of the inventive balun of FIG. 3.

FIG. 4 is a sketch of the balun 10 of FIG. 3. The inventive balun 10 includes first and second sets of semi-rigid coaxial cables. The first set 11 includes first and second coaxial cables 16 and 18. The second set 13 includes third and fourth coaxial cables 20 and 22. Each cable may be implemented with an off-the-shelf semi-rigid coaxial cable with a Teflon dielectric and a type N coaxial connector. In accordance with the present teachings, the first input lead 12 is connected to the center conductors 24 and 36 of the first and fourth coaxial cables 16 and 22, respectively. The second input lead 14 is connected to the center conductors 28 and 32 of the second and third coaxial cables 18 and 20, respectively. Within each set, the shields of the coaxial cables are connected. That is, the shields 26 and 30 of the first and second coaxial cables 16 and 18, respectively, are connected. Likewise, the shields 34 and 38 of the third and fourth coaxial cables 20 and 22 are connected. One center conductor from each set is connected to an output terminal and the other center conductor from each set is connected to the other set. Hence, the center conductor 24 of the first coaxial cable 16 is connected to the output lead 44. The center conductor 32 of the third coaxial cable 20 is connected to the output lead 42. The center conductor 28 of the second coaxial cable 18 is connected to the center conductor 36 of the fourth coaxial cable 22 by a jumper 40. The first and second input leads are connected to a coaxial coupler 46 as shown in FIG. 4.

The purpose of the inventive balun 10 is the same as the conventional balun 10' of FIGS. 1 and 2, viz., to transform the characteristic impedance of a transmitter and/or receiver to some multiple times its amount. As can be seen in FIG. 3, the inventive balun requires coaxial cables with the same characteristic impedance Z, as the transmitter/receiver impedance (one-half that of the prior art balun 10'). Each set of coaxial cables 11 and 13 of FIG. 3 acts as a transmission line of impedance 2Z. Hence, the inventive balun 10 appears to the transmitter/receiver to be electrically identical to the balun 10' constructed in accordance with conventional teachings.

Utilizing the teachings of the present invention, a balun can be constructed by one of ordinary skill in the art to transform an approximate a 200 ohm antenna input impedance to a 50 ohm transmitter output impedance. The required coaxial characteristic impedance for this balun is therefore only 50 ohms. As is common in the art, the outside diameter of each cable is based on the desired power handling capability. The center conductor diameter is based on the outside diameter and impedance specifications. Hence, the inventive balun would require a center conductor diameter of approximately 0.063" (for a 0.21" outer conductor diameter with a Teflon dielectric).

At RF (radio frequencies) and microwave frequencies, the skin depth of the center conductor may be assumed to be much smaller than its diameter. Hence, the coaxial cables of the balun 10' of FIGS. 1 and 2 will probably have over 3 times the loss of the cables of the inventive balun 10 due to the differences in the center conductor diameters.

Assuming both baluns can dissipate the same amount of heat, the inventive balun should be able to handle at least three times the power handled by the balun constructed in accordance with conventional teachings. Indeed, the inventive balun should be able to dissipate more heat due to the larger size of the center conductors used. As will be appreciated by those skilled in the art, low frequency operation can be improved by the use of optional ferrites 48 and 50 as shown in FIG. 4.

Thus, the present invention has been described herein with reference to a particular embodiment for a particular application. Those having ordinary skill in the art and access to the present teachings will recognize additional modifications applications and embodiments within the scope thereof. For example, baluns of different impedance transforming ratios can be constructed using the present teachings to achieve higher power handling capability. High power 450-to-50 ohm and 800-to-50 ohm coaxial baluns can be built by replacing 150 and 200 ohm coaxial cables required in accordance with conventional teachings with pairs of 75 and 100 ohm coaxial cables. This is significant inasmuch as 150 and 200 ohm coaxial cables are not believed to be available off-the-shelf currently.

FIG. 5 shows a 9:1 transforming balun 100' constructed in accordance with conventional teachings with 150 ohm coaxial cables 102', 104' and 106'.

FIG. 6 shows a 9:1 transforming balun 100 constructed in accordance with the teachings of the present invention. The balun 100 has three sets 102, 104 and 106 of first and second 75 ohm coaxial cables, 108 and 110 respectively. Each shield conductor of each cable within each set is connected to a shield conductor of the other coaxial cable of said set. The first input lead 112 is connected to a first end of a center conductor of a first coaxial cable of each set. The second input lead 114 is connected to a first end of a center conductor of a second coaxial cable of each set. A second end of a center conductor of a first coaxial cable 108 of one set of coaxial cables 102 provides an output lead for the balun 100. A second end of a center conductor of a second coaxial cable 110 of a set of coaxial cables 106 provides an output lead for the balun 100. A second end of each remaining center conductor of each coaxial cable of each set of coaxial cables is connected to a second end of a center conductor of a coaxial cable of another set of coaxial cables.

FIG. 7 shows a 16:1 coaxial balun 200' constructed in accordance with conventional teachings with 200 ohm coaxial cables 202', 204', 206' and 208'.

FIG. 8 shows a 16:1 transforming balun 200 constructed in accordance with the teachings of the present invention. In this case, four sets of first and second 100 coaxial cables are used to provide high power, broadband impedance transformation in accordance with the present teachings set forth above.

The teachings of the present invention may be extended further to cover applications where conductors other than coaxial cables are used. For example, those skilled in the art will appreciate that transmission lines of length appropriate for a required operational frequency, may be used in place of the coaxial cables of the illustrative embodiment without departing from the scope of the present teachings.

It is therefore intended by the appended claims to cover any and all such applications, modifications and embodiments within the scope of the present invention.

What is claimed is:

1. A broadband high power balun having first and second input leads and first and second output leads, said balun comprising:

plural sets of first and second cables, each cable having a first conductor and a second conductor, each second conductor of each cable within each set being connected to a second conductor of the other cable of said set;

said first input lead being connected to a first end of a first conductor of a first cable of each set;

said second input lead being connected to a first end of a first conductor of a second cable of each set;

a second end of a first conductor of a first cable of a set of cables providing an output lead for said balun;

a second end of a first conductor of a second cable of a set of cables providing an output lead for said balun; and a second end of each remaining first conductor of each cable of each set of cables being connected to a second end of a first conductor of a cable of another set of cables.

2. A broadband high power balun having first and second input leads and first and second output leads, said balun comprising:

plural sets of first and second coaxial cables, each cable having a center conductor and a shield conductor, each shield conductor of each cable within each set being connected to a shield conductor of the other coaxial cable of said set;

said first input lead being connected to a first end of a center conductor of a first coaxial cable of each set;

said second input lead being connected to a first end of a center conductor of a second coaxial cable of each set;

a second end of a center conductor of a first coaxial cable of a set of coaxial cables providing an output lead for said balun;

a second end of a center conductor of a second coaxial cable of a set of coaxial cables providing an output lead for said balun; and a second end of each remaining center conductor of each coaxial cable of each set of coaxial cables being connected to a second end of a center conductor of a coaxial cable of another set of coaxial cables.

3. A broadband high power balun having first and second input leads and first and second output leads, said balun comprising:

first and second sets of first and second coaxial cables, each cable having a center conductor and a shield conductor, each shield conductor of each cable within each set being connected to a shield conductor of the other coaxial cable of said set;

said first input lead being connected to a first end of a center conductor of a first coaxial cable of each set;

said second input lead being connected to a first end of a center conductor of a second coaxial cable of each set;

a second end of a center conductor of a first coaxial cable of said first set of coaxial cables providing an output lead for said balun;

a second end of a center conductor of a second coaxial cable of said second set of coaxial cables providing an output lead for said balun; and a second end of a center conductor of said second coaxial cable of said first set of coaxial cables being connected to a second end of a center conductor of a first coaxial cable of said second set of coaxial cables.

4. A broadband, high power balun having an input impedance $Z_1$ across first and second input leads and an output impedance $Z_2$ across first and second output leads, said balun comprising:

a first set of first and second coaxial cables having first and second center conductors with first and second shields, respectively;

a second set of third and fourth coaxial cables having third and fourth center conductors with third and fourth shields, respectively;

a first end of said first and fourth center conductors of said first and fourth coaxial cables, respectively, being connected to said first input lead;

a first end of said second and third center conductors of said second and third coaxial cables, respectively, being connected to said second input lead;

a second end of said first center conductor providing said second output lead;

a second end of said third center conductor providing said first output lead;

a second end of said second center conductor being connected to a second end of said fourth center conductor; and said first shield being connected to said second shield and said third shield being connected to said fourth shield.

5. The invention of claim 4 further including means for connecting said output leads to an antenna.

6. The invention of claim 4 wherein $Z_2=4Z_1$.

7. The invention of claim 4 wherein $Z_2=9Z_1$.

8. The invention of claim 4 wherein $Z_2=16Z_1$.

9. A method for providing in impedance match including the steps of:

providing first and second input leads and first and second output leads;

providing sets of first and second coaxial cables, each cable having a center conductor and a shield conductor;

coupling energy from each shield conductor of each cable within each set to a shield conductor of the other coaxial cable of said set;

coupling energy from said first input lead to a first end of a center conductor of a first coaxial cable of each set;

coupling energy from said second input lead to a first end of a center conductor of a second coaxial cable of each set;

coupling energy from a second end of a center conductor of a first coaxial cable of a set of coaxial cables to a first output lead for said balun;

coupling energy from a second end of a center conductor of a second coaxial cable of a set of coaxial cables to a second output lead for said balun; and coupling energy from a second end of each remaining center conductor of each coaxial cable of each set of coaxial cables to a second end of a center conductor of a coaxial cable of another set of coaxial cables.

* * * * *